US007432777B2

(12) United States Patent
Kawanami

(10) Patent No.: US 7,432,777 B2
(45) Date of Patent: Oct. 7, 2008

(54) NON-RECIPROCAL CIRCUIT ELEMENT, COMPOSITE ELECTRONIC COMPONENT, AND COMMUNICATION APPARATUS

(75) Inventor: Takashi Kawanami, Kanazawa (JP)

(73) Assignee: Murata Manufacturing Co., Ltd, Kyoto (JP)

( * ) Notice: Subject to any disclaimer, the term of this patent is extended or adjusted under 35 U.S.C. 154(b) by 0 days.

(21) Appl. No.: 12/020,701

(22) Filed: Jan. 28, 2008

(65) Prior Publication Data

US 2008/0111647 A1 May 15, 2008

Related U.S. Application Data

(63) Continuation of application No. PCT/JP2006/312782, filed on Jun. 27, 2006.

(30) Foreign Application Priority Data

Jul. 28, 2005 (JP) ..... 2005-219550

(51) Int. Cl.
*H01P 1/32* (2006.01)
*H01P 1/383* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 6,549,086 B2 4/2003 Kawanami
6,965,277 B2 11/2005 Kawanami
2006/0132255 A1 6/2006 Kawanami

FOREIGN PATENT DOCUMENTS

JP 52-052546 A 4/1977

(Continued)

OTHER PUBLICATIONS

Official communication issued in the International Application No. PCT/JP2006/312782, mailed on Aug. 1, 2006.

(Continued)

*Primary Examiner*—Stephen E Jones
(74) *Attorney, Agent, or Firm*—Keating & Bennett, LLP

(57) ABSTRACT

An isolator includes five center electrodes coupled at radio frequencies to a ferrite member to which a DC bias magnetic field is applied from a permanent magnet. First and third electrodes do not intersect each other. The first and third electrodes intersect the second, fourth and fifth electrodes with electrical insulation therebetween. Connection is established so that a magnetic field generated when current flows from one end to the other end of the first electrode and a magnetic field generated when current flows from one end to the other end of the third electrode are in phase and in the same direction. Connection is established so that a magnetic field generated when current flows from one end to the other end of the second electrode, a magnetic field generated when current flows from one end to the other end of the fourth electrode, and a magnetic field generated when current flows from one end to the other end of the fifth electrode are in phase and in the same direction. The one end of the first electrode and the other end of the third electrode define balanced input ports, and the one end of the fourth electrode defines an unbalanced output port.

6 Claims, 5 Drawing Sheets

FOREIGN PATENT DOCUMENTS

| | | | |
|---|---|---|---|
| JP | 2004-088743 | A | 3/2004 |
| JP | 2004-289301 | A | 10/2004 |
| JP | 2004-299916 | A | 10/2004 |
| JP | 2004-304434 | A | 10/2004 |

OTHER PUBLICATIONS

Kawanami; "Non-Reciprocal Circuit Element, Composite Electronic Component, and Communication Apparatus"; U.S. Appl. No. 12/020,723, filed Jan. 28, 2008.

NON-RECIPROCAL CIRCUIT ELEMENT, COMPOSITE ELECTRONIC COMPONENT, AND COMMUNICATION APPARATUS

BACKGROUND OF THE INVENTION

1. Field of the Invention

The present invention relates to non-reciprocal circuit elements, and more particularly, to a two-port non-reciprocal circuit element, such as an isolator, for use in a microwave band, a composite electronic component having the element, and a communication apparatus having the element or the composite electronic component.

2. Description of the Related Art

Known non-reciprocal circuit elements, such as isolators and circulators, have characteristics that allow transmission of signals only in a predetermined specific direction and not in the opposite direction. Using the characteristics, for example, isolators are used in transmission circuit sections in mobile communication apparatuses, such as cellular phones.

A balun, a hybrid circuit, or a power coupler has been provided at an output side of a known balanced output circuit, in particular, a push-pull amplifier (having a pair of amplifiers operating with a 180-degree phase difference). Using the balun, balanced signals are converted into an unbalanced signal.

In contrast, Japanese Unexamined Patent Application Publication No. 2002-299915 (Patent Document 1) discloses a 3-port isolator, defining a non-reciprocal circuit element, in which center electrodes at input ports are balance-connected, thereby allowing the isolator to be connectable to a balanced output circuit without using a balun or a hybrid circuit interposed therebetween. Japanese Unexamined Patent Application Publication No. 2004-282626 (Patent Document 2) discloses a balanced-input/balanced-output two-port isolator, which is a high-isolation equivalent circuit that is connectable to a balanced circuit without using a balanced-unbalanced converter interposed therebetween.

A three-port isolator, such as that described in Patent Document 1, has a problem in that, since the three-port isolator has a narrow input matching band and requires input/output ports dedicated to terminating resistors and center electrodes, the circuit is complicated, which results in a higher cost and lower reliability.

A high-isolation two-port isolator, such as that described in Patent Document 2, has a problem in that, since the high-isolation two-port isolator has a narrow passband and a large insertion loss, the high-isolation two-port isolator is not suitable for use in transmitters. Since the high-isolation two-port isolator generates excess heat, the high-isolation two-port isolator has low reliability.

SUMMARY OF THE INVENTION

To overcome the problems described above, preferred embodiments of the present invention provide a balanced-input/unbalanced-output non-reciprocal circuit element, a composite electronic component, and a communication apparatus having a simple circuit configuration, low insertion loss, and high reliability.

A non-reciprocal circuit element according to a preferred embodiment of the present invention is a non-reciprocal circuit element with a plurality of center electrodes coupled at radio frequencies to a ferrite member to which a bias magnetic field is applied from a permanent magnet, wherein first to fifth center electrodes are provided on the ferrite member; the first and third center electrodes do not intersect each other, and the first and third center electrodes intersect the second, fourth, and fifth center electrodes with electrical insulation therebetween; connection is established so that a magnetic field generated when current is flows from one end to the other end of the first center electrode and a magnetic field generated when current flows from one end to the other end of the third center electrode are in phase and in the same direction; connection is established so that a magnetic field generated when current flows from one end to the other end of the second center electrode, a magnetic field generated when current flows from one end to the other end of the fourth center electrode, and a magnetic field generated when current flows from one end to the other end of the fifth center electrode are in phase and in the same direction; a first matching capacitor and a first terminating resistor are connected in parallel to the first center electrode, a second matching capacitor is connected in parallel to the second center electrode, and a third matching capacitor and a second terminating resistor are connected in parallel to the third center electrode; and the one end of the first center electrode and the other end of the third center electrode define balanced input ports, and the one end of the fourth center electrode defines an unbalanced output port.

In the non-reciprocal circuit element according to this preferred embodiment, the first and third center electrodes do not intersect each other, and the first and third center electrodes intersect the second, fourth, and fifth center electrodes with electrical insulation therebetween. The first matching capacitor and the first terminating resistor are connected in parallel to the first center electrode. The second matching capacitor is connected in parallel to the second center electrode. The third matching capacitor and the second terminating resistor are connected in parallel to the third center electrode.

Accordingly, a compact, lumped-constant isolator having a simple circuit configuration, low insertion loss, and wideband input matching characteristics is provided.

Connection is established so that a magnetic field generated when current flows from the one end to the other end of the first center electrode and a magnetic field generated when current flows from the one end to the other end of the third center electrode are in phase and in the same direction. Connection is established so that a magnetic field generated when current flows from the one end to the other end of the second center electrode, a magnetic field generated when current flows from the one end to the other end of the fourth center electrode, and a magnetic field generated when current flows from the one end to the other end of the fifth center electrode are in phase and in the same direction. The one end of the first center electrode and the other end of the third center electrode define balanced input ports, and the one end of the fourth center electrode defines an unbalanced output port. Accordingly, a balanced-input/unbalanced-output isolator is achieved without adding a balun.

In the non-reciprocal circuit element according to a preferred embodiment, it is preferable that at least the second center electrode be wound one or more times around the ferrite member. Accordingly, the inductance of the second center electrode is increased, and input matching can be achieved in a wider band, thereby facilitating matching with previous-stage circuits including a power amplifier.

It is preferable that the second center electrode have an electrical length of substantially a quarter wavelength or a wavelength slightly less than the quarter wavelength. Accordingly, the inductance of the second center electrode increases significantly, and resonance can be achieved without actually connecting the second matching capacitor. Possible degradation of insertion loss due to the Q value of the second matching capacitor is prevented. Furthermore, input matching can be achieved in a still wider band, and matching with previous-stage circuits including a power amplifier is facilitated.

A composite electronic component according to another preferred embodiment of the present invention includes the foregoing non-reciprocal circuit element connected to outputs of a pair of amplifiers that operate with an approximately 180-degree phase difference. Accordingly, an unbalanced signal can be output without providing a balun. Excellent electrical characteristics can be obtained, and the size of an apparatus can be reduced.

A communication apparatus according to another preferred embodiment of the present invention includes the foregoing non-reciprocal circuit element or the foregoing composite circuit component. Accordingly, excellent electrical characteristics can be obtained, and the size of the apparatus can be reduced.

According to preferred embodiments of the present invention, electrical characteristics of an isolator can be used for an unbalanced signal without adding a balun. Size reduction, resource saving, and cost reduction are achieved. The insertion loss is reduced, and wideband input matching characteristics are achieved. Since the isolator generates low heat, high reliability is also achieved.

Other features, elements, characteristics and advantages of the present invention will become more apparent from the following detailed description of preferred embodiments of the present invention (with reference to the attached drawings).

DETAILED DESCRIPTION OF THE PREFERRED EMBODIMENTS

Hereinafter, preferred embodiments of a non-reciprocal circuit element, a composite electronic component, and a communication apparatus according to the present invention will be described with reference to the accompanying drawings.

Isolator

Figure 1:
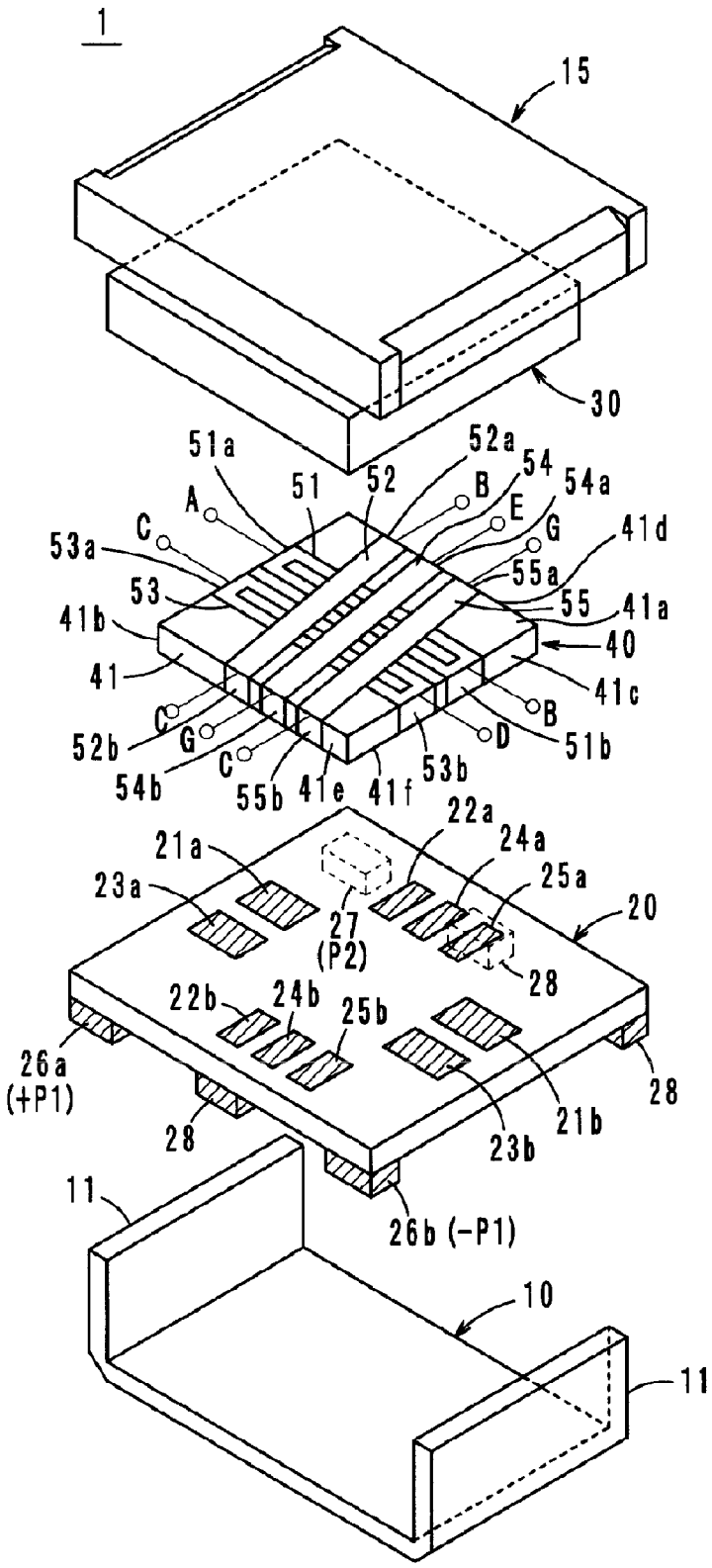
FIG. 1 is an exploded perspective view showing an isolator according to a preferred embodiment of the present invention.

FIG. 1 is an exploded perspective view of an isolator 1 which is a preferred embodiment of a non-reciprocal circuit element according to the present invention. The isolator 1 is a lumped-constant isolator. Schematically, the isolator 1 includes a metal casing 10, a metal cap 15, a circuit board 20, a permanent magnet 30, and a center electrode assembly 40. The center electrode assembly 40 includes a ferrite member 41 and center electrodes 51 to 55, which will be described later in detail.

The casing 10 and the cap 15 are made of a ferromagnetic material, such as soft iron, with a thickness ranging from approximately 0.05 mm to approximately 0.25 mm. The casing 10 and the cap 15 are configured as frames surrounding the circuit board 20, the center electrode assembly 40, and the permanent magnet 30. Two sides 11 of the casing 10 are conductively connected to sides of the cap 15, whereby the casing 10, the cap 15, and the permanent magnet 30 define a magnetic circuit. The casing 10 and the cap 15 are plated with copper with a thickness ranging from approximately 0.1 μm to approximately 100 μm, and then with silver with a thickness ranging from approximately 1 μm to approximately 5 μm. Accordingly, the rate at which the isolator 1 begins to rust is reduced, and a conductor loss caused by excessive current generated due to radio-frequency (RF)-magnetic flux or a ground current is minimized.

The permanent magnet 30 applies a direct current (DC) bias magnetic field to a main face 41*a* of the ferrite member 41 in a direction substantially perpendicular to the main face 41*a*. As shown in an equivalent circuit of the isolator 1 in FIG. 2, the first center electrode 51 (inductor L1) and the second center electrode 52 (inductor L2) are coupled to each other at radio frequencies via the ferrite member 41, and the third center electrode 53 (inductor L3) and the second center electrode 52 are connected to each other at radio frequencies via the ferrite member 41. Also, the fourth center electrode 54 (inductor L4) and the fifth center electrode 55 (inductor L5) are coupled to the second center electrode 52 at radio frequencies.

In general, a strontium, barium, or lanthanum-cobalt ferrite magnet is used as the permanent magnet 30. Since magnets made of these materials are dielectrics whereas metal magnets are conductors, RF magnetic fluxes can be distributed inside the permanent magnet 30 with low loss. Therefore, even when the permanent magnet 30 is provided near the center electrodes 51 to 55, electrical characteristics including insertion loss are negligibly deteriorated. Since these materials have temperature characteristics similar to those of the ferrite member 41, the temperature characteristics as an isolator are improved.

The center electrode assembly 40 includes the center electrodes 51 to 55, which are insulated from one another, on the first main face 41*a* (surface) of the ferrite member 41, which is a rectangular parallelepiped. The first center electrode 51 and the third center electrode 53 do not intersect each other. The first and third center electrodes 51 and 53 intersect the second, fourth, and fifth center electrodes 52, 54, and 55 with electrical insulation therebetween.

More specifically, one end 51*a* of the first center electrode 51 is located on a first side face 41*b* of the ferrite member 41, and the other end 51*b* of the first center electrode 51 is located on a second side face 41*c*. The one end 51*a* is referred to as electrode A, and the other end 51*b* is referred to as electrode B. One end 52*a* of the second center electrode 52 is located on a third side face 41*d* of the ferrite member 41, and the other end 52*b* of the second center electrode 52 is located on a fourth side face 41*e*. The one end 52*a* is referred to as electrode B, and the other end 52*b* is referred to as electrode C. One end 53*a* of the third center electrode 53 is located on the first side face 41*b* of the ferrite member 41, and the other end 53*b* of the third center electrode 53 is located on the second side face 41*c*. The one end 53*a* is referred to as electrode C, and the other end 53*b* is referred to as electrode D.

Furthermore, one end 54*a* of the fourth center electrode 54 is located on the third side face 41*d* of the ferrite member 41, and the other end 54*b* of the fourth center electrode 54 is located on the fourth side face 41*e*. The one end 54*a* is referred to as electrode E, and the other end 54*b* is referred to as electrode G. Similarly, one end 55*a* of the fifth center electrode 55 is located on the third side face 41*d* of the ferrite member 41, and the other end 55*b* of the fifth center electrode 55 is located on the fourth side face 41*e*. The one end 55*a* is referred to as electrode G, and the other end 55*b* is referred to as electrode C.

It is preferable to provide, on the main face 41*a* and the side faces 41*b* to 41*e* of the ferrite member 41, the center electrodes 51 to 55 which are metal plates or metal foils made of copper or copper alloy and which are plated with silver or silver alloy. Alternatively, the center electrodes 51 to 55 may be formed as film electrodes, such as thick films or thin films made of silver or copper. Using processing techniques such as printing, transferring, photolithography, etching, and other suitable processing techniques, the center electrodes 51 to 55 may be formed into predetermined shapes with high accuracy. YIG ferrite or other suitable ferrite material is used for the ferrite member 41.

Figure 2:
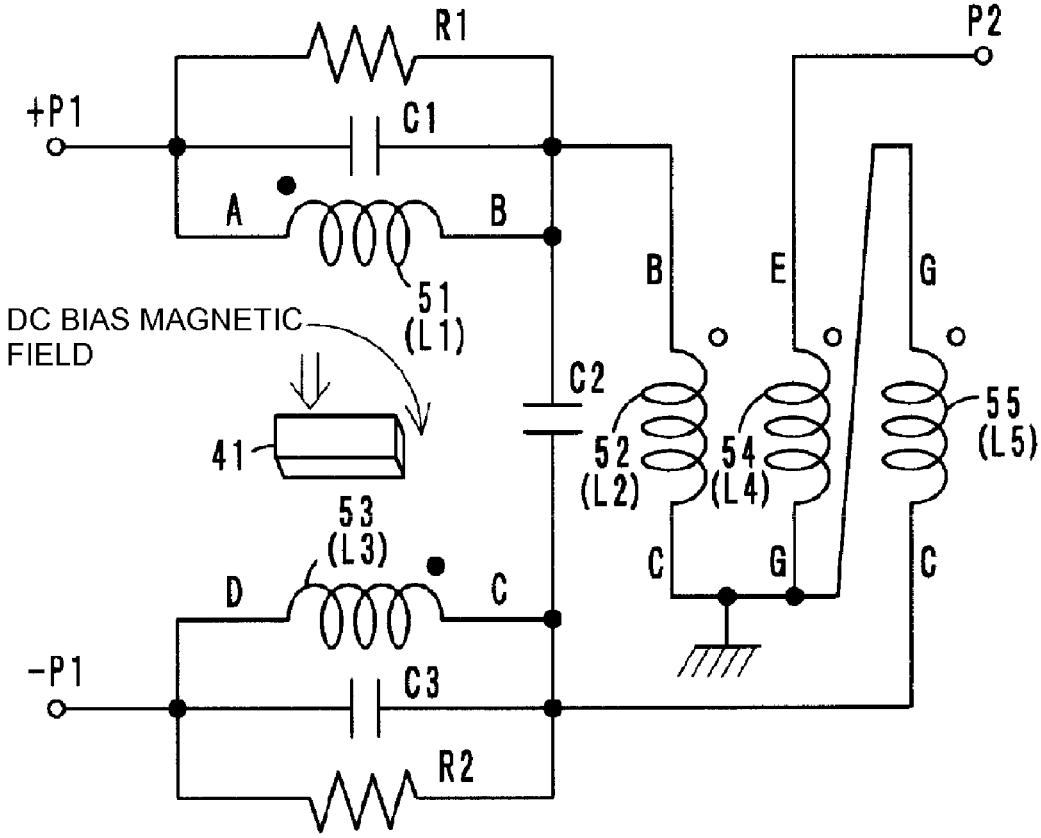
FIG. 2 is an equivalent circuit diagram of the isolator shown in FIG. 1.
Figure 3:
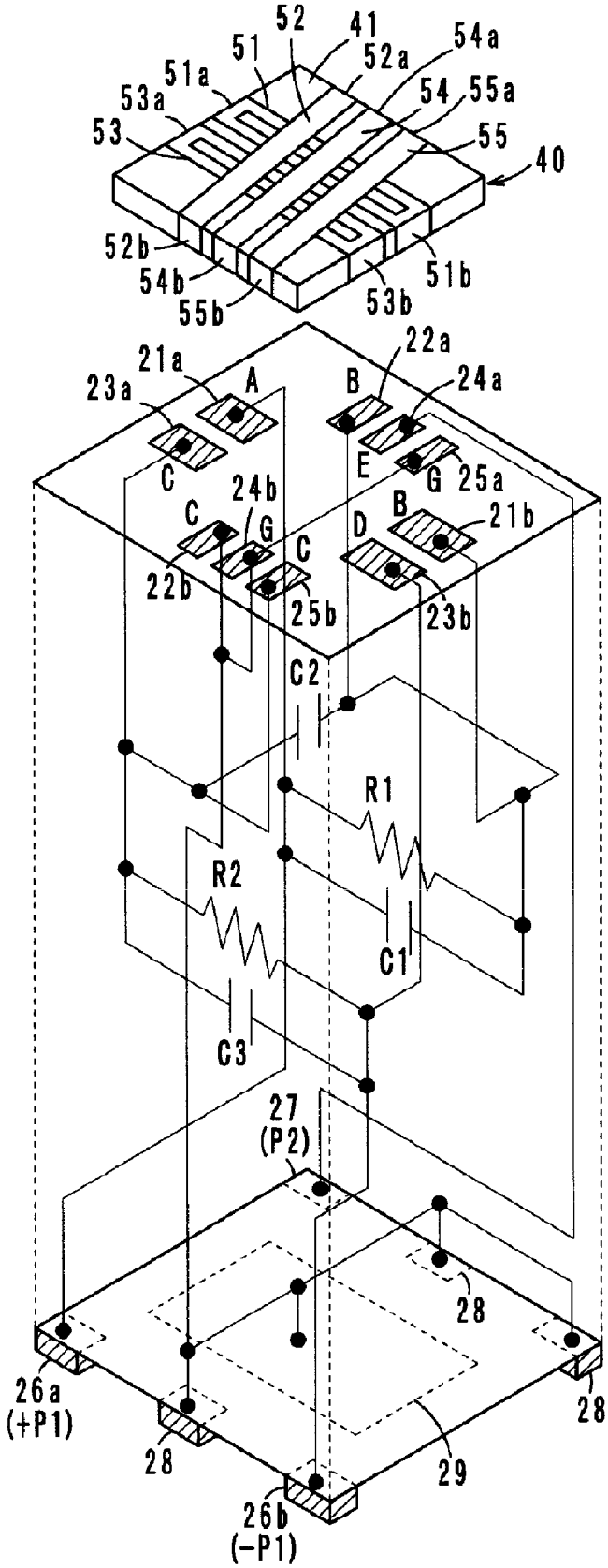
FIG. 3 is a block diagram showing the circuit configuration inside a circuit board defining the isolator shown in FIG. 1.

The circuit board 20 is a laminated board fabricated by forming predetermined electrodes on a plurality of dielectric sheets, stacking the plurality of sheets, and sintering the laminated sheets. As shown in FIGS. 2 and 3, the circuit board 20 includes matching capacitors C1, C2, and C3 and terminating resistors R1 and R2. Terminal electrodes 21*a*, 21*b*, 22*a*, 22*b*, 23*a*, 23*b*, 24*a*, 24*b*, 25*a*, and 25*b* are provided on the top of the circuit board 20, and external-connection terminal electrodes 26*a*, 26*b*, 27, and 28 and a ground electrode 29 are provided on the bottom of the circuit board 20.

A sintered mixture of glass, alumina, and other dielectrics, which can be sintered at the same time as thick-film conductor electrodes or a composite board made of resin, glass, and other dielectrics is used as the circuit board 20. Thick films made of silver or silver alloy, copper thick films, copper foils, and other suitable materials are used as electrodes inside and outside the circuit board 20. In particular, the external-connection terminal electrodes 26*a*, 26*b*, 27, and 28 are preferably plated with nickel with a thickness ranging from about 0.1 μm to about 5 μm and then with gold with a thickness of about 0.01 μm to about 1 μm. This is to make the circuit board 20 better anti-rust and anti-solder-corrosion. As a result, a failure, such as a reduction in the strength of solder jointing due to a vulnerable alloy layer made by diffusion of metal unnecessary for soldering, is prevented from occurring.

Regarding the external-connection terminal electrodes 26*a*, 26*b*, 27, and 28, thick film electrodes are made thicker so as to protrude, and the thickness of the bottom of the casing 10 is made equivalent, thereby improving the soldering to a mounting circuit board.

The circuit configuration of the isolator 1 will now be described. FIG. 2 shows the equivalent circuit of the isolator 1. FIG. 3 shows the circuit configuration inside the circuit board 20.

More specifically, connection is established so that a magnetic field generated when current flows from the one end 51*a* (electrode A) to the other end of the first center electrode 51 and a magnetic field generated when current flows from the one end 53*a* (electrode C) to the other end of the third center electrode 53 are in phase and in the same direction. Also, connection is established so that a magnetic field generated when current flows from the one end 52*a* (electrode B) to the other end of the second center electrode 52, a magnetic field generated when current flows from the one end 54*a* (electrode E) to the other end of the fourth center electrode 54, and a magnetic field generated when current flows from the one end 55*a* (electrode G) to the other end of the fifth center electrode 55 are in phase and in the same direction. The other ends 52*b* and 54*b* (electrode C and electrode G) of the second and fourth center electrodes 52 and 54 and the one end 55*a* (electrode G) of the fifth center electrode 55 are connected to ground. The other end 55*b* (electrode C) of the fifth center electrode 55 is connected to the one end 53*a* (electrode C) of the third center electrode 53.

The first matching capacitor C1 and the first terminating resistor R1 are connected in parallel to the first center electrode 51. The second matching capacitor C2 is connected in parallel to the second center electrode 52. The third matching capacitor C3 and the second terminating resistor R2 are connected in parallel to the third center electrode 53.

The one end 51*a* (electrode A) of the first center electrode 51 and the other end 53*b* (electrode D) of the third center electrode 53 define balanced input ports +P1 and −P1. The one end 54*a* (electrode E) of the fourth center electrode 54 defines an unbalanced output port P2.

That is, as shown in the block diagram of FIG. 3, the external connection terminal electrode 26*a* provided on the bottom of the circuit board 20 defines the balanced input port +P1. The terminal electrode 26*b* defines the balanced input port −P1. The terminal electrode 27 defines the unbalanced output port P2.

The terminal electrodes 21*a* and 21*b* provided on a surface of the circuit board 20 are connected to the one end 51*a* and the other end 51*b*, respectively, of the first center electrode 51. The terminal electrodes 22*a* and 22*b* are connected to the one end 52*a* and the other end 52*b*, respectively, of the second center electrode 52. The terminal electrodes 23*a* and 23*b* are connected to the one end 53*a* and the other end 53*b*, respectively, of the third center electrode 53. The terminal electrodes 24*a* and 24*b* are connected to the one end 54*a* and the other end 54*b*, respectively, of the fourth center electrode 54. The terminal electrodes 25*a* and 25*b* are connected to the one end 55*a* and the other end 55*b*, respectively, of the fifth center electrode 55.

According to the isolator 1 having the configuration described above, when balanced signals (differential signals with a 180-degree phase difference) are input to the balanced input ports +P1 and −P1, current flows through the first center electrode 51, and an RF magnetic field is generated at the ferrite member 41. Due to this RF magnetic field, current flows through the second center electrode 52, which is magnetically coupled to the first center electrode 51, and the second, fourth, and fifth center electrodes 52, 54, and 55 operate in a similar manner to a balun circuit, and the current is transmitted as an unbalanced signal from the one end 54*a* of the fourth center electrode 54 to the unbalanced output port P2.

That is, the first and third center electrodes 51 and 53 do not intersect each other. The first and third center electrodes 51 and 53 intersect the second, fourth, and fifth center electrodes 52, 54, and 55 with electrical insulation therebetween. The first matching capacitor C1 and the first terminating resistor R1 are connected in parallel to the first center electrode 51. The second matching capacitor C2 is connected in parallel to the second center electrode 52. The third matching capacitor C3 and the second terminating resistor R2 are connected in parallel to the third center electrode 53. Therefore, the isolator 1 is a compact, lumped-constant isolator having a simple circuit configuration, low insertion loss, and wideband input matching characteristics.

Figure 4:
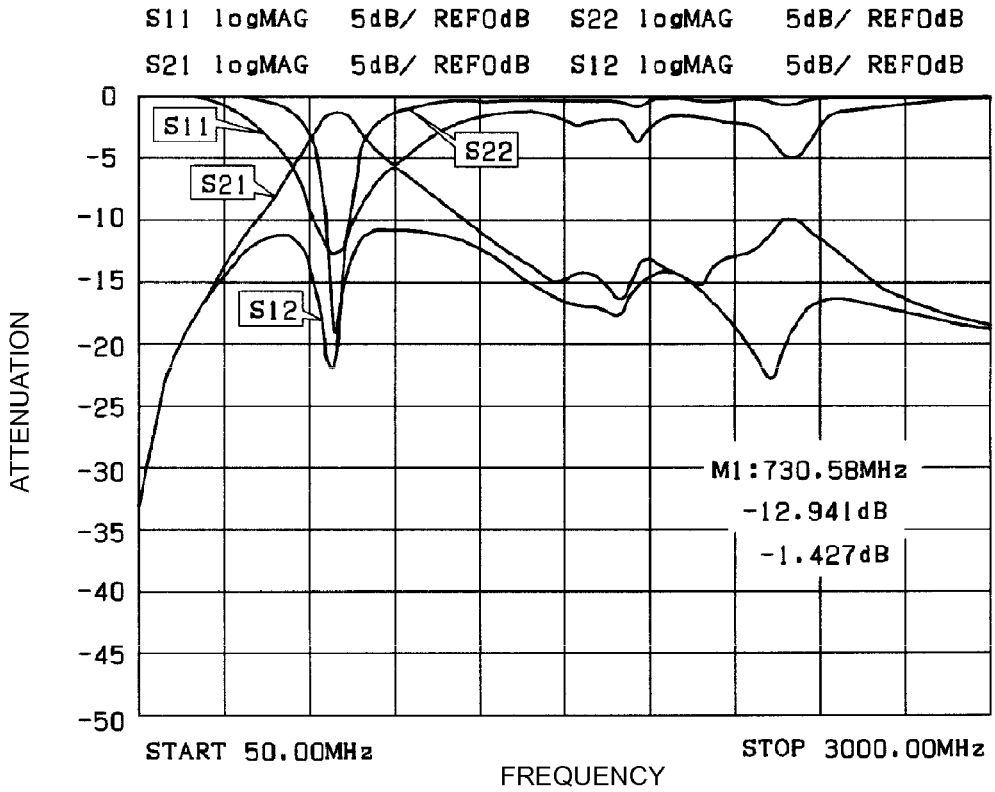
FIG. 4 is a graph showing S-parameter characteristics when opposite-phase signals are applied to two balanced input ports of the isolator shown in FIG. 1.

FIG. 4 illustrates S-parameter characteristics when an opposite-phase (balanced, differential, and balanced) signal source/load is connected to the two balanced input ports of the isolator. As shown in FIG. 4, a forward-direction transmission characteristic (S21) is large in an operation frequency band from 700 MHz to 800 MHz, and signals are transmitted with a small loss. A reverse-direction transmission characteristic (S12) is very small. Thus, signals are not transmitted, and attenuation is very large. Therefore, it is clear that the isolator 1 has large isolation characteristics relative to reverse-direction signals.

Figure 5:
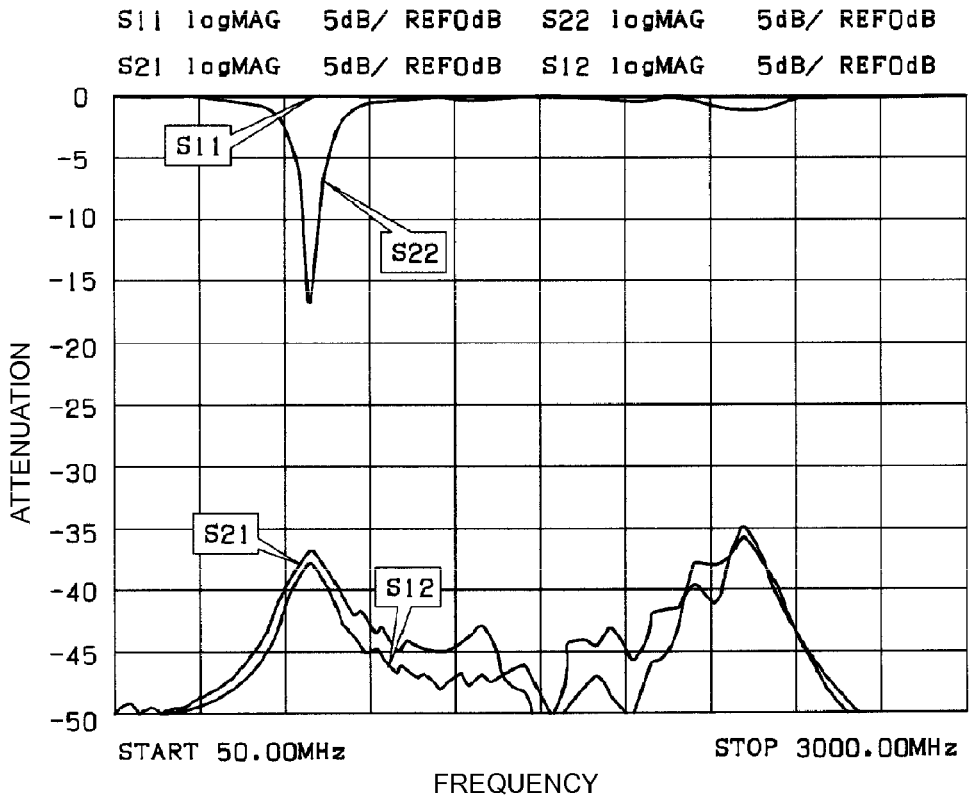
FIG. 5 is a graph showing S-parameter characteristics when in-phase signals are applied to the two balanced input ports of the isolators which are connected to each other.

FIG. 5 illustrates S-parameter characteristics when an in-phase (unbalanced and unbalanced) signal source is connected to the two balanced input ports of the isolator. In this case, the two balanced input ports are connected to each other. As shown in FIG. 5, a forward-direction transmission characteristic (S21) is less than −30 dB, which is very small, in a wide frequency band from 50 MHz to 3000 MHz, and signals are not transmitted. The same applies to a reverse-direction transmission characteristic (S12). Signals are not transmitted, and attenuation is very large.

As is clear from a comparison of FIGS. 4 and 5, the isolator 1 has excellent balanced characteristics, that is, an excellent common mode rejection ratio.

Furthermore, connection is established so that a magnetic field generated when current flows from the one end 51*a* (electrode A) to the other end of the first center electrode 51 and a magnetic field generated when current flows from the one end 53*a* (electrode C) to the other end of the third center electrode 53 are in phase and in the same direction. Also, connection is established so that a magnetic field generated when current flows from the one end 52*a* (electrode B) to the other end of the second center electrode 52, a magnetic field generated when current flows from the one end 54*a* (electrode E) to the other end of the fourth center electrode 54, and a magnetic field generated when current flows from the one end 55*a* (electrode G) to the other end of the fifth center electrode 55 are in phase and in the same direction. Also, the one end 51*a* (electrode A) of the first center electrode 51 and the other end 53*b* (electrode D) of the third center electrode 53 define balanced input ports +P1 and −P1, and the one end 54*a* (electrode E) of the fourth center electrode 54 defines an unbalanced output port P2. Accordingly, a balanced-input/unbalanced-output isolator can be provided without adding a balun.

The capacitances of the matching capacitors C1, C2, and C3 are selected so that resonance occurs at an operation frequency in conjunction with the center electrodes 51, 52, 53, and 55. Regarding the terminating resistors R1 and R2, when the isolator 1 is used in a circuit with about 50Ω, a value of approximately 50Ω is selected. Depending on the inductances of the center electrodes 51 to 55, a value ranging from approximately 25Ω to approximately 100Ω is appropriate.

It is preferable to use elements with high Q values, that is, elements with low loss, as a combined inductance of the second center electrode 52 and the fifth center electrode 55 and the second matching capacitor C2. If the combined inductance and the Q values are low, the insertion loss increases. Even if the first center electrode 51, the first matching capacitor C1, the third center electrode 53, and the third matching capacitor C3 have low Q values, the insertion loss does not increase. However, if these elements have extremely low Q values, the isolation bandwidth decreases.

In the first preferred embodiment, the circuit board 20 is a multilayer dielectric board. Therefore, the circuit board 20 can include circuit networks including capacitors and inductors, which results in a reduction of the size and thickness of the isolator 1. Since circuit elements are connected inside the board, reliability is significantly improved. However, the circuit board 20 need not necessarily be a multilayer board. Instead, the circuit board 20 may include only a single layer, and the matching capacitors and terminating resonators may be chips that are externally mounted on the circuit board 20.

The external-connection terminal electrodes 26*a*, 26*b*, 27, and 28 arranged to mount the isolator 1 to a printed circuit board of a communication apparatus are provided on the bottom of the circuit board 20. Accordingly, the number of points at which electrical connections are established is reduced, thereby reducing loss and increasing reliability. Furthermore, other terminal components need not be provided, thereby further reducing the cost. Since the bottom of the circuit board 20 becomes a terminal face, the height of the circuit board 20 can be reduced.

The second center electrode 52 may be wound one or more times around the main faces 41*a* and 41*f* of the ferrite member 41. As the number of turns is increased, the inductance of the second center electrode 52 increases. Accordingly, input matching can be achieved in a wider band, and matching with previous-stage circuits including a power amplifier is facilitated.

It is preferable that the electrical length of the second center electrode 52 be substantially a quarter wavelength or a wavelength slightly less than the quarter wavelength. Thus, the inductance of the second center electrode 52 becomes extremely large, and resonance is achieved without actually connecting the second matching capacitor C2. Possible degradation of insertion loss due to the Q value of the second matching capacitor C2 is overcome. Furthermore, input matching can be achieved in a still wider band, and matching with previous-stage circuits including a power amplifier is facilitated.

Composite Electronic Component

Figure 6:
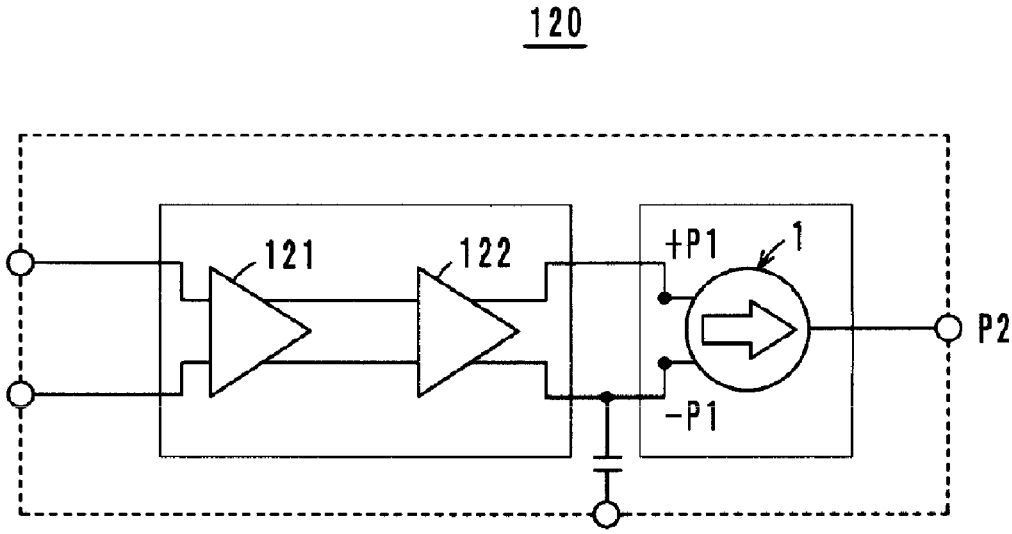
FIG. 6 is a block diagram showing an electric circuit of a composite electronic component according to another preferred embodiment of the present invention.

FIG. 6 is a block diagram of a composite electronic component 120 (push-pull amplifier) in which the isolator 1 is connected to balanced amplifiers 121 and 122. A balun is required for connecting a known push-pull amplifier to an antenna or an unbalanced coaxial cable. Thus, it is difficult to reduce the size of such a known push-pull amplifier, and its applications to mobile communication apparatuses are severely limited. However, with the use of the unbalanced-output isolator 1, the composite electronic component 120 can be manufactured with a reduced size and can be connectable to a high-performance unbalanced circuit.

Communication Apparatus

Figure 7:
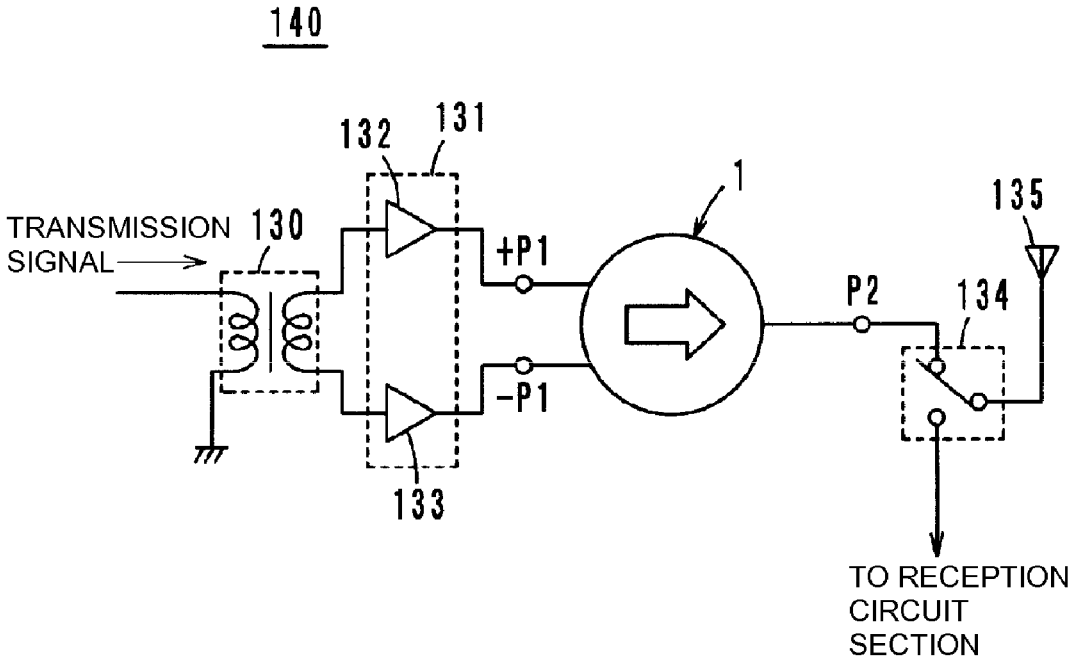
FIG. 7 is a block diagram showing an electric circuit of a communication apparatus according to another preferred embodiment of the present invention.

FIG. 7 is an electric circuit diagram of a cellular phone 140 in which the isolator 1 is included in a transmission circuit section. Reference numeral 130 denotes a balun. Reference numeral 131 denotes a push-pull amplifier including a pair of amplifiers 132 and 133 operating with a 180-degree phase difference. Reference numeral 134 denotes an antenna switch. Reference numeral 135 denotes an antenna element.

The balanced input ports +P1 and −P1 of the isolator 1 are feed elements and connected to balanced outputs of the push-pull amplifier 131. The unbalanced output port P2 is connected to the antenna switch 134.

The isolator 1 can be connected to the outputs of the push-pull amplifier 131 without including a balun or a hybrid circuit therebetween. The transmission circuit section can be manufactured with a reduced size, and the cost thereof can be reduced. Furthermore, a cellular phone 140 with a low insertion loss, less radiation, and a wide operation frequency band is provided.

The push-pull amplifier 131 has characteristics in which the generation of second harmonics occurs less often, whereas third harmonics become a problem. In contrast, the isolator 1 greatly suppresses third harmonics. Thus, excellent electrical characteristics are achieved by combining the push-pull amplifier 131 and the isolator 1.

The non-reciprocal circuit element, the composite electronic component, and the communication apparatus according to the present invention are not limited to the foregoing preferred embodiments, and various changes can be made without departing from the scope of the present invention.

In particular, instead of configuring the ferrite member as a rectangular parallelepiped, the ferrite member may have a disc shape, a hexagonal shape, or an octagonal shape. The circuit board 20 can have an arbitrary configuration. In the foregoing preferred embodiments, the center electrode assembly 40 is arranged in a horizontal manner such that the main face 41*a* of the ferrite member 41 is arranged substantially parallel to the circuit board 20. Alternatively, the center electrode assembly 40 may be arranged in a vertical manner such that the main face 41*a* of the ferrite member 41 is arranged substantially perpendicular to the circuit board 20. In this case, if the center electrode assembly 40 is sandwiched between a pair of permanent magnets 30, the distribution of DC bias magnetic fields is improved, thereby more easily achieving low loss and wideband operation.

As described above, the present invention is effective in two-port non-reciprocal circuit elements, such as isolators used in a microwave band, and more particularly, the two-port non-reciprocal circuit elements are advantageous in terms of simple circuit configuration, low insertion loss, and excellent reliability.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A non-reciprocal circuit element comprising:

a permanent magnet;

a ferrite member; and a plurality of center electrodes coupled at radio frequencies to the ferrite member to which a bias magnetic field is applied from the permanent magnet; wherein first to fifth center electrodes are provided on the ferrite member;

the first and third center electrodes do not intersect each other, and the first and third center electrodes intersect the second, fourth, and fifth center electrodes with electrical insulation therebetween;

connection is established so that a magnetic field generated when current flows from one end to the other end of the first center electrode and a magnetic field generated when current flows from one end to the other end of the third center electrode are in phase and in the same direction;

connection is established so that a magnetic field generated when current flows from one end to the other end of the second center electrode, a magnetic field generated when current flows from one end to the other end of the fourth center electrode, and a magnetic field generated when current flows from one end to the other end of the fifth center electrode are in phase and in the same direction;

a first matching capacitor and a first terminating resistor are connected in parallel to the first center electrode, a second matching capacitor is connected in parallel to the second center electrode, and a third matching capacitor and a second terminating resistor are connected in parallel to the third center electrode; and the one end of the first center electrode and the other end of the third center electrode define balanced input ports, and the one end of the fourth center electrode defines an unbalanced output port.

2. The non-reciprocal circuit element according to claim 1, wherein at least the second center electrode is wound at least one time around the ferrite member.

3. The non-reciprocal circuit element according to claim 1, wherein the second center electrode has an electrical length of substantially a quarter wavelength or a wavelength slightly less than the quarter wavelength.

4. A communication apparatus comprising the non-reciprocal circuit element according to claim 1.

5. A composite electronic component comprising:

a pair of amplifiers arranged to operate with an approximately 180-degrees phase difference; and the non-reciprocal circuit element according to claim 1 connected to outputs of the pair of amplifiers.

6. A communication apparatus comprising the composite circuit component according to claim 5.

* * * * *